US006302741B1

(12) United States Patent
Fasold et al.

(10) Patent No.: US 6,302,741 B1
(45) Date of Patent: Oct. 16, 2001

(54) MODULAR CONNECTOR WITH DC DECOUPLING AND FILTERING

(75) Inventors: Michael Fasold, Leutenbach; Herbert Endres, Bad Wimpfen; Otto Schempp, Bad Rappenau, all of (DE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/420,884

(22) Filed: Oct. 19, 1999

(30) Foreign Application Priority Data

Oct. 29, 1998 (DE) ..... 298 19 314 U

(51) Int. Cl.[7] ..... H01R 13/66; H01R 33/345; H01R 13/60; H01R 15/502; H01R 12/00

(52) U.S. Cl. ..... 439/620; 439/541.5

(58) Field of Search ..... 439/620, 541.5, 439/676, 701, 79

(56) References Cited

U.S. PATENT DOCUMENTS

| | | | |
|---|---|---|---|
| 4,772,224 | 9/1988 | Talend | 439/607 |
| 5,015,204 | 5/1991 | Sakamoto et al. | 439/620 |
| 5,069,641 | 12/1991 | Sakamoto et al. | 439/620 |
| 5,139,442 | 8/1992 | Sakamoto et al. | 439/620 |
| 5,282,759 | 2/1994 | Sakamoto et al. | 439/620 |
| 5,531,612 | 7/1996 | Goodall et al. | 439/541.5 |
| 5,587,884 | 12/1996 | Raman | 361/728 |
| 5,687,233 | 11/1997 | Loudermilk et al. | 379/442 |
| 5,816,830 * | 10/1998 | Griffith et al. | 439/79 |
| 6,019,631 * | 2/2000 | Chen | 439/541.5 |

FOREIGN PATENT DOCUMENTS

| | | |
|---|---|---|
| WO 97/19499 | 5/1997 | (WO) . |
| WO 97/47083 | 12/1997 | (WO) . |
| WO 98/54789 | 12/1998 | (WO) . |

* cited by examiner

*Primary Examiner*—Gary Paumen
*Assistant Examiner*—Edwin A. Leon
(74) *Attorney, Agent, or Firm*—A. A. Tirva

(57) ABSTRACT

The invention discloses a modular jack type connector having a dielectric connector housing 11 and a plurality of contacts 1 to 8 and 1' to 8"arranged in the connector housing for contactingly engaging contacts of a mateable connector when said mateable connector is inserted in a receptacle 9, 10 defined by said connector housing. The modular jack type connector further comprises a subassembly T1, T2, 46, 48 and a dc separation of the contacts 1 to 8 and 1' to 8' from external terminals and comprises a filtering device CC1, CC2, 47, 49. An element 31, 32 which is substantially completely insertable into said connector housing 11 holds contacts 1 to 8 and 1' to 8' associated with the contacts of said mateable connector and said external terminals, and the insertable element 31, 32 accommodates both said subassembly for a dc separation T1, T2, 46, 48 and said filtering device CC1, CC2, 47, 49.

9 Claims, 9 Drawing Sheets

MODULAR CONNECTOR WITH DC DECOUPLING AND FILTERING

FIELD OF THE INVENTION

The invention relates to a modular jack type connector in general and in particular to a modular jack type connector with a subassembly for dc separation and a filtering device.

BACKGROUND OF THE INVENTION

With ever-increasing operating frequencies of data and communication systems and an increased density of information to be transmitted, the electrical characteristics of connectors as mentioned above are of increasing importance. In particular, it has to be ensured that these modular jack type connectors do not have deleterious effects on the signals to be transmitted and that no additional interference is introduced. Based on these requirements, various proposals have been made in order to minimize negative influences, especially of modular jack connectors, used with communication or transmission links.

PCT Patent Application No. WO 98/54789 discloses a modular jack assembly which includes an outer insulative housing having top and bottom walls and opposed lateral walls defining a receptacle for a mateable modular plug connector. This assembly includes an insulative insert having a top section, an upper side and a rear section having a base side and a recess. This insert is positioned so that the upper side of its top section is adjacent to the top side of the insulative housing such that the terminals thereof extend into the receptacle. However, due to its configuration the insert is not apt to be used in a connector with a plurality of receptacles if these receptacles are arranged in more than one line. Different types of inserts would have to be used for such a design increasing costs arising from production of the different components and causing a more complicated assemblage.

PCT Patent Application No. WO 97/19499 proposes, in case of a RJ-45 modular jack, to use capacitors in an insert of the modular jack housing and contact sections held by the insert which contact sections are apt to mate with the contacts of an associated modular plug connector. In this way an attempt is made to obtain an impedance matching of the modular jack-type connector with the associated modular plug connector.

However, many interference signals are present on a transmission line, and may thereby considerably impair the transmission properties of the whole path consisting of transmission lines and associated connectors. As a result thereof, the attainable transmission rates are restricted, in particular in the data communication at higher frequencies, such as category 5, 6 or higher. Moreover, faulty transmissions and temporary breakdowns may occur when, e.g. low frequency interference signals or ripple loops are formed by magnetic induction or by electromagnetic interference on the line. Frequently, local potential differences of the ground potential between the transmission and reception locations are apt to severely reduce the desired signal amplitude.

For the elimination of in-phase interference signal noise components, U.S. Pat. No. 5,015,204 teaches use of a common-mode choke arranged in a connector housing around which the contact leads of a RJ-45 modular jack connector are integrally wound. In this design, the voluminous common-mode choke takes up a substantial portion of the connector housing, although only two signal-conducting leads are used. Furthermore, the respective leads need a certain rigidity to provide resilient forces to continuously facilitate a secure contact with the associated modular plug connector. However, this creates difficult manufacturing conditions, especially when the rigid wires, consisting of phosphor bronze, have to be wound around the conductive core of the choke coil.

U.S. Pat. No. 5,069,641 avoids such difficulties by the use of a printed circuit board to receive the common-mode choke coils or to receive electronic chip inductances. The printed circuit board not only requires its own space, but also needs several additional production steps in order to connect it to the components and the leads thereof.

U.S. Pat. No. 5,587,884 proposes transformers for signal conditioning for a transmission in IEEE 10 Base-T Ethernet networks. Modular jack designs proposed therein include, however, a multi-part insert which includes the electrical components and which insert clearly projects out from the rear portion of the modular jack housing. The insert includes an injection molded element in the region of the contacts for the associated modular jack connector, which injection molded element is intended to guide and stabilize these contacts. This results, in comparison to the conventional RJ-45 modular jack connector, in a significant increase in the connector housing's height and depth. These modular jack connectors are therefore, in many cases not suitable, e.g. if the required mounting space is restricted, for example, as in network hubs with numerous connections for associated modular jack connectors, or in adapters for PCMCIA cards.

It is an object of the invention to facilitate the suppression of interfering signals in a modular jack, and in particular to suppress interfering signals which arise on the transmission lines, and furthermore to provide a modular jack type connector which is apt to save mounting space and is simple to assemble.

SUMMARY OF THE INVENTION

In a first preferred embodiment the invention, a modular jack type connector, includes

- a dielectric connector housing,
- a plurality of contacts arranged in said connector housing for contactingly engaging contacts of a mateable connector when said mateable connector is inserted into a receptacle defined by said connector housing,
- a plurality of external terminals for establishing an external electrical connection to said modular jack type connector,
- a subassembly for a dc separation of the contacts associated with the contacts of said mateable connector from said external terminals,
- a filtering device,
- an element which is substantially completely insertable into said connector housing which insertable element holds both said contacts associated with the contacts of said mateable connector and said external terminals, and
- which insertable element accommodates both said subassembly for a dc separation and said filtering device.

According to the invention a one-piece insertable element is provided, which is easy to manipulate during production and mounting which mounting substantially consists only of the insertion of the insertable element into the housing.

Furthermore, the very compact, one-piece design of the insertable element also supports the further design of the modular jack-type connector as a multiple modular jack connector arrangement, with several receptacles for respective associated modular plug connectors. According to the invention, it is also possible in a very simple manner, to use nearly identical insertable elements for different configurations of modular jack connector housings, and to arrange e.g. them one above the other or side by side in a very dense configuration. A simple mounting step of the parallel insertion of the respective insertable elements in essentially the same direction, facilitates the mounting of many insertable elements in parallel and in only a single manufacturing step. Accordingly, even the mounting of a multiple modular jack connector arrangement with its different electrical functional units can essentially take place in a single working step, even with a large number of insertable elements.

A very compact design of the insertable element is obtained in a further preferred embodiment in which the insertable element has a substantially square-shaped dielectric housing, through the side walls of which a respective section of the contacts for the associated modular jack connector and a section of the external terminals extend. The dielectric housing then securely holds the contacts for the associated modular jack connector and the external terminals relative to each other in the correct mounting position, i.e., in the later operating position thereof.

Moreover, a very compact design of the modular jack housing insertable element further is obtained in a further preferred embodiment wherein the contacts associated with a mateable modular plug connector are arranged side by side and form laterally outward extending arches running in parallel to one another and projecting in their mounted position into the interior of the receptacle defined by the modular jack connector housing for the associated modular plug connector.

It is furthermore particularly advantageous that the contacts associated with a mateable modular plug connector have, in addition to the laterally outward extending arches, at least one further curved region which increases the effective resilient length of each respective contact.

Within the insertable element, interactions that might occur between the electrical components and cause interference signals due to cross-talk are reduced, as in a preferred embodiment the longitudinal axes of the ferrite ring cores are respectively aligned parallel to each other and are arranged with a lateral offset.

As a consequence thereof it is possible to attain a small housing height, with the ferrite ring cores being arranged adjacently in one plane within the dielectric housing of the insertable element.

In an advantageous manner, certain inductances, i.e. transformer coils, within the dielectric housing of the insertable element are connected to a section of the external terminals and to a section of the contacts for the associated modular jack connector which section respectively projects into the housing for a certain length.

Not only a space-saving arrangement is provided in this manner, but also electrical connection losses within the modular jack connector are reduced.

Further electrical connections, e.g. leads or wires, are connected between the inductances within the dielectric housing of the insertable element and, accordingly, even without the use of printed circuit boards, predetermined electrical circuit arrangements are implemented in an advantageous manner, i.e. with very short leads and only a very minor amount of space consumed.

Embedding of the components accommodated in the housing of the insertable element within a permanently elastic dielectric material provides a height reliability in terms of mechanical failure. Such insertable elements are apt to withstand rough environmental conditions and may be manufactured in different places, i.e. where the conditions are best suited, which do not have to be the locations of the final assembly.

A multiple modular jack connector arrangement includes, in a preferred manner, a dielectric modular jack connector housing with several receptacles for respectively associated modular plug connectors, and each receptacle is respectively allocated with its own insertable element. A further space saving arrangement of the respective printed circuit board is obtained when the dielectric housing of the modular jack connector includes two rows of receptacles for respective associated modular jack connectors, in which the contact arrangements of the two rows within the receptacle are arranged as mutual mirror imagewise configurations.

The invention is described hereinbelow in the light of preferred embodiments in more detail with reference to the accompanying drawings.

BRIEF DESCRIPTION OF THE DRAWINGS

A

DETAILED DESCRIPTION OF THE PREFERRED EMBODIMENT

Figure 2:
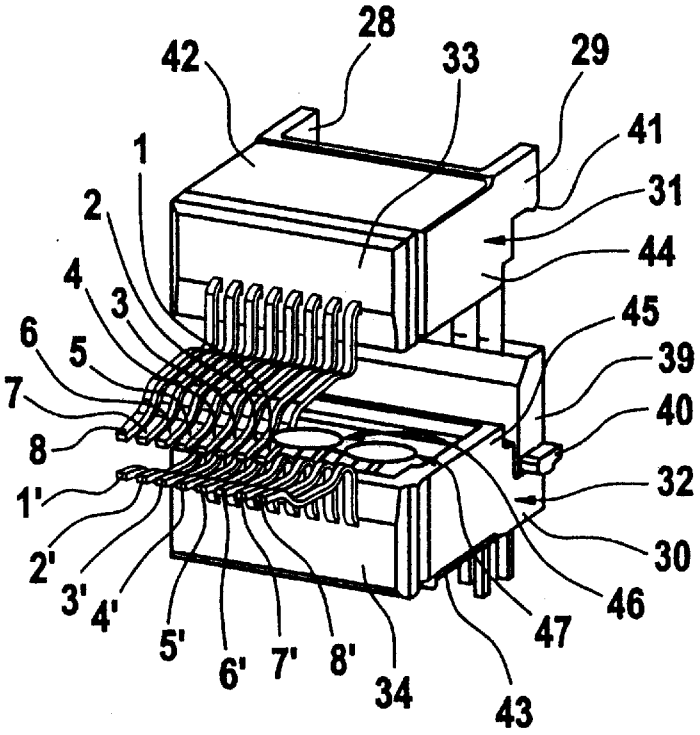
FIG. 2 shows two elements insertable into the modular jack connector housing, which have substantially mirror-imagewise arranged contacts, and which are shown in their position relative to one another, being essentially the position adopted when mounted in the modular jack connector housing.

In the following detailed description of preferred embodiments according to the invention, for the sake of clarity and of simplicity, elements which are identical or similar in function are denoted by the same numeral, and, moreover, figures are not always reproduced to scale.

Furthermore, all of the embodiments according to the invention described hereinbelow are suited for application in local area networks, but are not limited hereto, and in particular are apt to be used with twisted pair cable, as is described, for example, in IEEE 802.3 10 Base-T for Ethernet networks specification.

A most preferred embodiment according to the invention includes eight-pole RJ-45 modular jack connectors which are described in more detail below and with reference to FIGS. 1 and 2.

The contacts 1, 2, 3, 4, 5, 6, 7, 8 associated with a mateable RJ-45 modular plug connector (which associated mateable RJ-45 modular plug connector is well known to a person skilled in the art and, therefore, not shown in the drawings) respectively project laterally, i.e., slightly from above and slightly from below as shown FIG. 1, respectively, in front receptacle 9, 10 of dielectric connector housing 11.

A respective associated eight-pole RJ-45 modular plug connector (not shown in the drawing) is insertable into receptacles 9, 10 from the front side of the modular jack housing 11. Hereby openings 18, 19 in the upper side wall 16 or lower side wall 17 of dielectric modular jack connector housing 11, permit a modular jack design with particularly low housing height. The upper and lower side walls 16, 17 of receptacles 9, 10, respectively, define openings 18, 19 but still provide a secure seating of an inserted associated modular plug connector. The locking of the latch element of an inserted, associated modular plug takes place in a reliable manner due to the cooperation with ramp-shaped projections 12, 13, 14, 15 of dielectric housing 11 which project laterally into openings 18, 19.

At the rear end, openings 18 and 19 on the upper and lower sides extend to a floor or roof wall section 20, 21.

Figure 4:
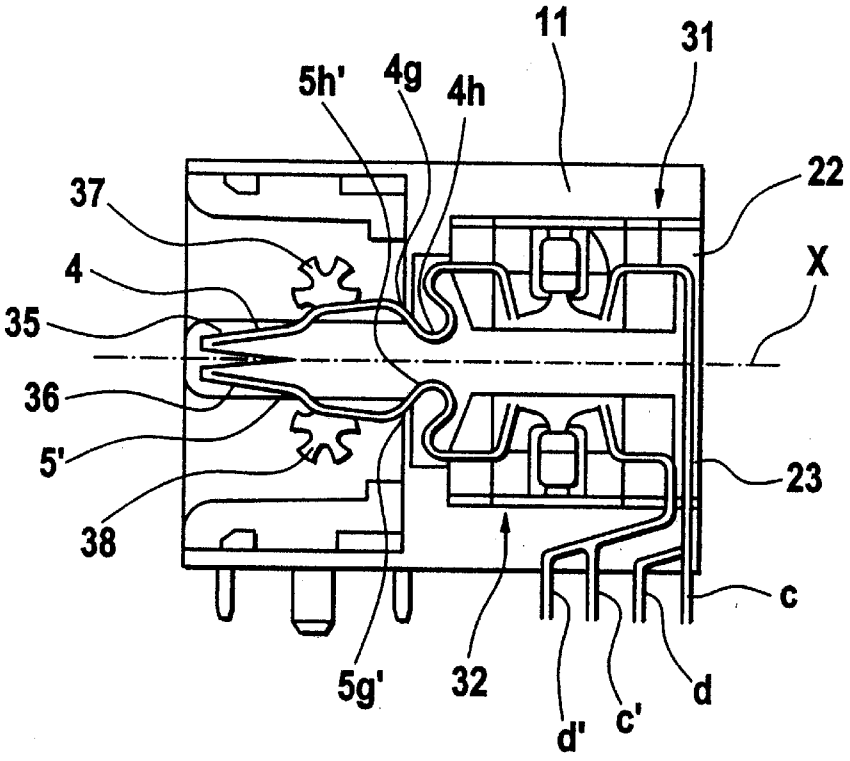
FIG. 4 shows a horizontal cross section of a further inventive embodiment, extending approximately through the center of the respective modular jack connector housing.

Two insertion channels 22 and 23, are arranged one above the other and are open to the rear side of dielectric modular jack housing 11; whereby, as is best seen in FIG. 4, the longitudinal extension of insertion channels 22 and 23 runs essentially parallel to the insertion direction of the associated modular jack connector.

Figure 1:
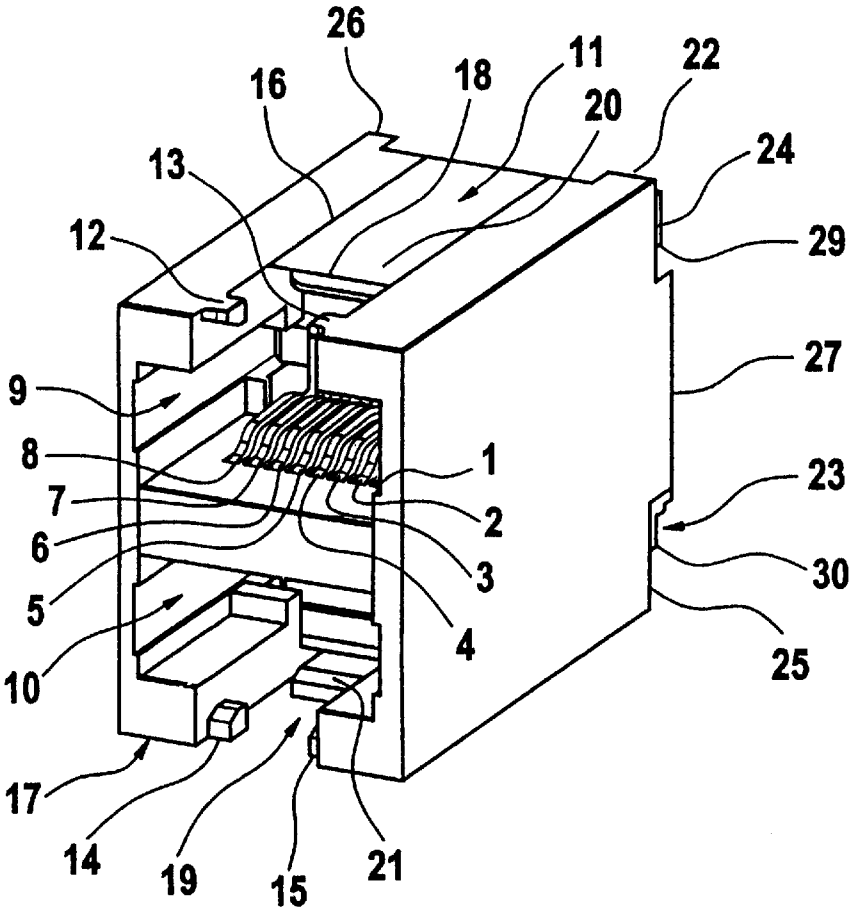
FIG. 1 shows a perspective view of a first embodiment with two receptacles for associated RJ-45 modular plug connectors, seen obliquely from a slightly elevated angle of view.

In the embodiment of modular jack connector housing 11 shown in FIG. 1, rectangular-shaped recesses 24, 25, 26 can be seen, respectively recessed toward the center of modular jack connector housing 11 with respect to center rear wall section 27, in order to allow rearward-extending handling members 28, 29, 30 of insertable elements 31 and 32 to stand out freely.

In an alternative embodiment, for example in the embodiment according to the invention as shown in FIG. 4, the modular jack connector housing 11 is designed without recesses 24, 25, 26, and insertable elements 31 are designed without operating members 28, 29, 30, so that the housing depth of modular jack connector housing 11 is reduced.

Reference is next made to FIG. 2, in which two insertable elements 31, 32 are shown in their relative positions to one another. The positions are assumed in the modular jack connector housing 11 after assembly of the insertable elements 31, 32. The respective contacts associated with the mateable modular plug connector of the element 31, 1 to 8, and of the element 32, 1' to 8', are arranged adjacent to one another, and respectively extend out of the front side 33 or 34 of the insertable element 31, 32, such that after insertion of the elements 31 and 32 into the channels 22 and 23, respectively, of the modular jack connector housing 11 the respective contacts assume their operating position and are biased in the direction toward the contacts of an inserted associated modular plug connector.

As can be seen from the cross sectional view of FIG. 4, contacts 1 to 8 and 1' to 8' have, at least in a forward section, when insertable elements 31, 32 are arranged in the insertion channels 22, 23, a slight inclination toward the longitudinal axis X of the modular jack connector housing 11. Respectively, ramp-shaped inward-directed, center housing wall sections 35, 36 project over a front section of the contacts such that during the last part of the insertion all of the contacts 1 to 8 and 1' to 8' are slightly bent back in a direction toward the centerline X of the modular jack housing 11 until they experience a predefined bias or prestress in the direction of contacts 37, 38 of the otherwise not further described associated mateable modular modular plug connector. Contacts 37, 38 are shown in FIGS. 4 to 7 for the sake of clarity to obtain a better understanding of the interaction between an associated mateable modular plug and the modular jack.

In the inserted position, the elements 31, 32 may be held captive by a respective rear side locking and holding element 39 as e.g. may be seen from in FIG. 2. The locking element 39, shown only by way of example for the insertable element 32, has a respective latching projection 40 which extends in a lateral direction on lateral end sides of the holding element 39. The wedge-shaped latching projection 41 which is shown only for the operating member 29 in FIG. 2 by way of example, is also formed on the operating element 30 and can in this manner reliably prevent a movement of the elements 31, 32 in the longitudinal direction of the insertion channels 22, 23 if the respective holding element 39 is secured to the modular jack housing 11 in a position inhibiting any movement of the insertable elements in a longitudinal direction of insertion channels 22, 23.

Furthermore, locking element 39, is in a two-row embodiment of the modular jack connector housing 11 with two or more receptacles 9, 10, apt to hold the external terminals a to h of an upper row element 31 or elements 31 in a predefined fixed position. To that end, the external terminals a to h of an upper row element 31 or elements 31 are embedded in the dielectric material of locking element 39.

The base surfaces, facing respectively toward the upper and lower outer side of insertable elements 31, 32 having substantially the shape of a rectangular prism preferably include cover plates 42, 43 or cover foils 42, 43, which cover the interior of the dielectric housing 44, 45 of the element 31, 32, as shown in FIG. 2.

The interior of the dielectric housing 44, 45, after placement of its electrical components, is filled with or embedded with a permanently elastic dielectric material, therefor, no components can be seen in FIG. 2 and only the relative position of two inductances is shown by circles 46 and 47 for the sake of a better understanding.

Without any limitation of generality, acid-free silicon rubber materials are preferably used as permanently elastic dielectric material in the embodiments shown.

Figure 3:
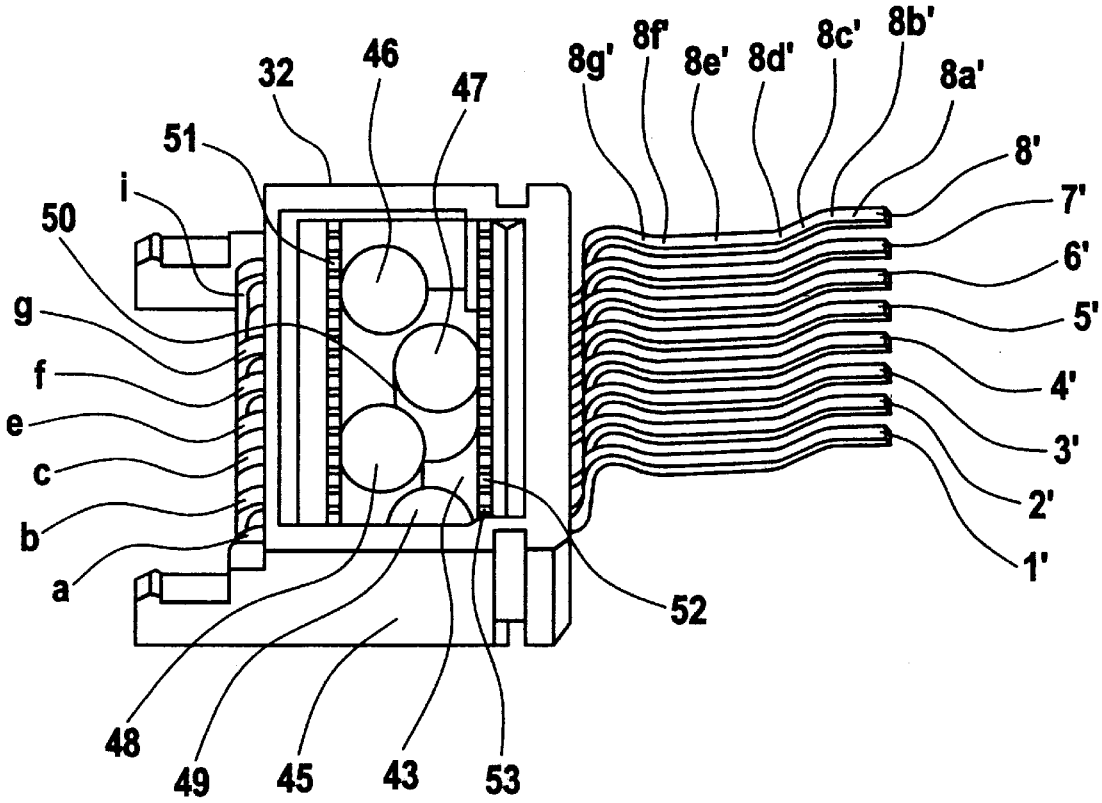
FIG. 3 shows a perspective view of an insertable element before embedding of the ferrite ring core inductances within an elastic dielectric material.

For a still better understanding, element 32 in FIG. 3 is shown in a perspective view obliquely from above, and without the permanently elastic dielectric sealing medium. Inductances 46, 47, 48, 49 comprising ferrite ring cores are adjacently arranged in one plane lying within substantially square dielectric housing 45, such that the longitudinal or center axes thereof are respectively aligned mutually parallel but laterally offset from one another.

Inductances 46, 47, 48, 49 shown in FIG. 3 are, according to the design of the electric circuit, respectively, electrically connected to external terminals a to h by means of sections 50, 51 (shown only by way of example), and are connected to contacts 1', 2' by means of sections 52, 53, likewise shown only by way of example. A more detailed electrical connection scheme will be described hereinbelow with reference to FIGS. 13 to 17.

Furthermore, still with reference to FIG. 3, the shape of contacts 1' to 8', which are arranged parallel to one another and which are similar in their respective shape, are described by way of example with regard to contact 8'.

Contact 8', which is in its longitudinal extension in the inserted position of element 32 slightly inclined toward center line X of modular jack housing 11, has first, i.e. at its remote end a substantially straight section 8*a*'. Section 8*a*' merges into a region 8*b*' which is in the assembled position of insertable element 32 slightly curved downward toward the interior of receptacle 10. Further from region 8*b*', contact 8' first defines a small straight piece 8*c*' and thereafter a further curved section 8*d*' connecting substantially straight center piece 8*e*' with section 8*c'*.

Substantially straight center piece 8*e*' also has in the assembled position of insertable element 32 a slight inclination with respect to the center line X of modular jack connector housing 11, so that upon insertion of the associated mateable modular plug connector a resilient elastic contact is established and center piece 8*e*' moves back generating a predefined bias and a defined electrical contact. Subsequent to center piece 8*e*', contact 8' has two curved regions 8*f* and 8*g*', which in the mounted state, again lead the laterally outward arched region of the contact back toward the exterior of receptacle 10.

For clarification purposes, reference will be made hereinbelow to contacts 4, 5' shown in the cross sectional view of FIG. 4, in order to explain, the further course of substantially like-shaped contacts 1' to 8' as well as 1 to 8.

Joined to contact section 5*g*' there follows a substantially s-shaped section 5*h*', see also mirror-image section 4*g* and 4*h* which respectively extend the effective resilient lengths of contacts 4 and 5'. By means of this omega-shaped region located substantially behind the respective outward arched center section of the respective contact, the elastic spring behavior of the respective contact is adjustable within the wide limits by selecting the size of this region.

Figure 5:
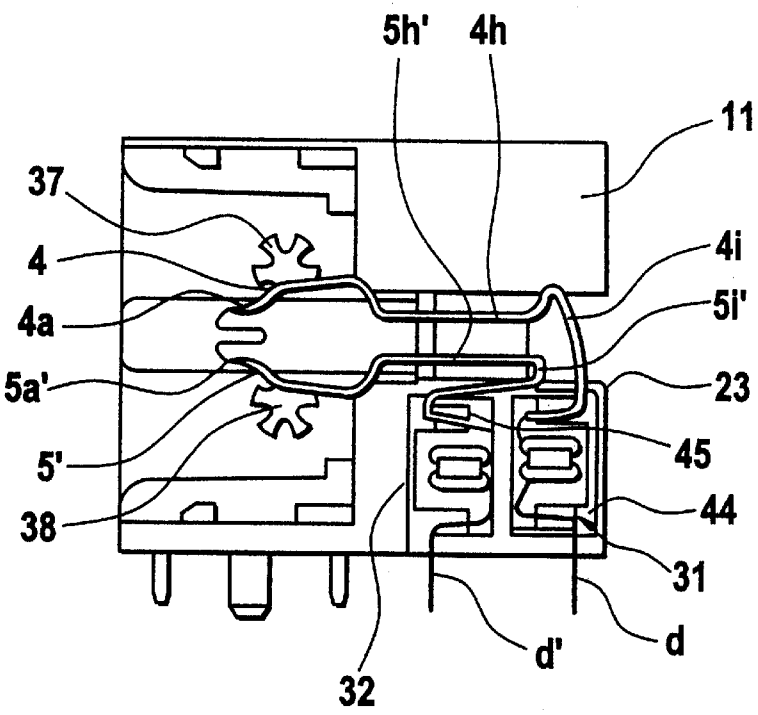
FIG. 5 shows a cross sectional view, corresponding essentially to FIG. 4, of a still further embodiment according to the invention.
Figure 7:
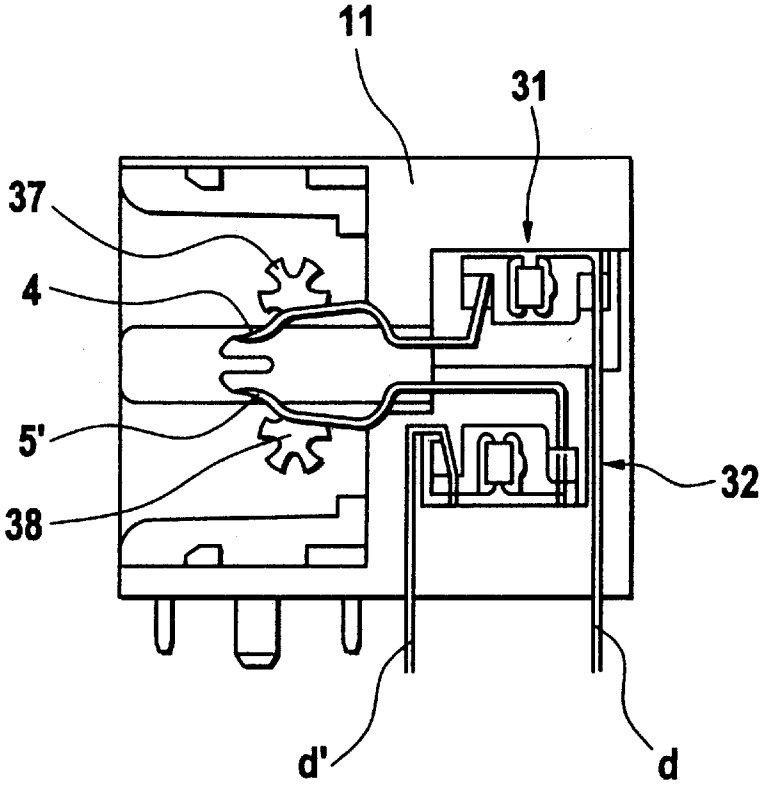
FIG. 7 shows a cross sectional view, corresponding essentially to FIGS. 4,5 and 6, of a still further inventive embodiment.
Figure 6:
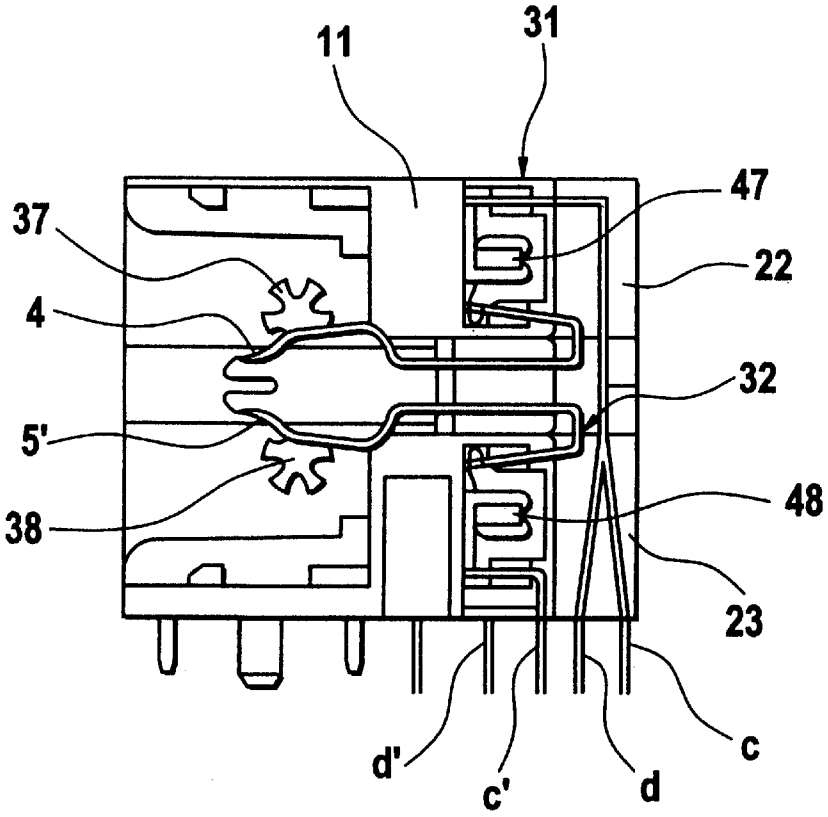
FIG. 6 shows a cross sectional view, corresponding essentially to FIGS. 4 and 5, of a further embodiment according to the invention.

Reference is next made to FIGS. 5 to 7, in which different alternative embodiments are shown in cross sectional views running horizontally in the middle of dielectric connector housing 11.

Referring first to the cross sectional view of FIG. 5, it shows two elements 31, 32 arranged one behind the other in insertion channel 23. The embodiment shown in FIG. 5 has, instead of rear s-shaped contact section 5*h*', 4*h*, respectively a u-shaped contact section 4*i* and 5*i*', which in case of contact section 5*i*' turns into a bend running sharply to the left directly at dielectric housing 45 of element 32.

In order to increase the effective resilient length of contacts 4 and 5', according to FIG. 5, they each have a short straight section behind receptacle 9, 10. Behind this short straight section there extends a further straight section 4*h*, 5*h*' which preferably is insert molded in dielectrical material and which then emerges from the dielectric material of modular jack connector housing 11 and, in case of contact 4, merges directly into an upward bend, adjoined by a substantially U-shaped section 4*i* which then leads uninterruptedly into dielectric housing 44 of element 31.

Furthermore, respective forward contact sections 5*a*' and 4*a* arranged in receptacle 9, 10 are kept substantially shorter than in the embodiments shown in FIGS. 1, 2, 3 and 4.

The embodiment shown in FIG. 6 has, in contrast to the embodiment shown in FIG. 4, two elements 30, 31 which are pivoted relative on one another for an angle of about 180°. Instead of the contacts which run laterally, this embodiment has contacts which emerge at the respective lateral end from elements 31, 32. In this embodiment, not only the longitudinal axes of the ferrite ring cores are arranged with a mutual lateral offset within the respective elements 31, 32, but also the longitudinal axes of the ferrite ring cores of different elements 31, 32 are arranged laterally offset from one another but remain essentially in the same plane. The coupling by stray magnetic fields is thereby greatly reduced, i.e. is of a very low strength.

In a yet further embodiment shown in FIG. 7, external connections d, d' of elements 31, 32 emerge at opposite sides of dielectric housing 44, 45, in order to obtain thereby a large spacing and a very small cross-talk for the external terminals.

In the embodiments shown in FIGS. 5 and 7, terminals a to i and a' to i' are respectively located in one plane, such that only external terminals d and d' can be seen in the cross sectional view.

In the embodiments shown in FIGS. 4 and 6, external terminals a to i of element 31, and external terminals a' to i' of element 32, are alternately arranged to be laterally offset to each other and thereby form for each connection element 30, 31 two rows of external terminal elements, whereby the cross-talk between each row of external terminals a to i and a' to i' is reduced.

Figure 9:
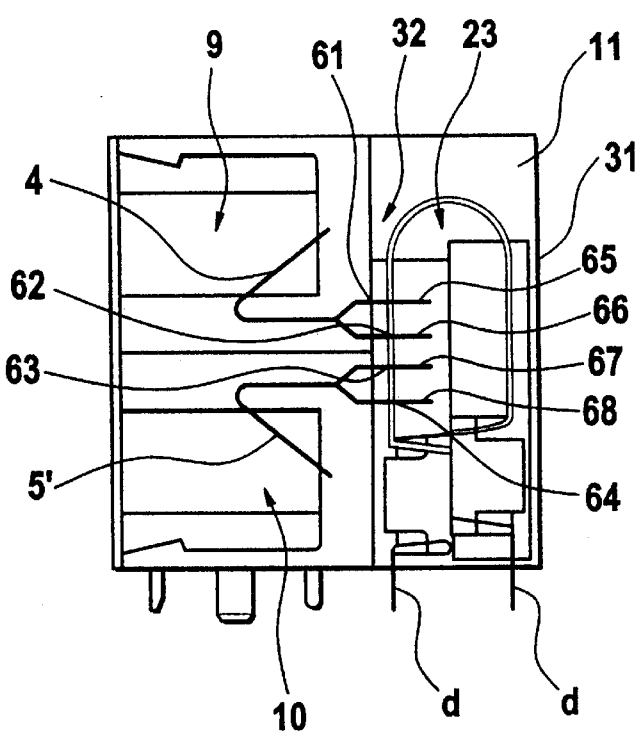
FIG. 9 shows a horizontal cross section along the plane A–A' of FIG. 8, in accordance with a still further embodiment of the invention.
Figure 8:
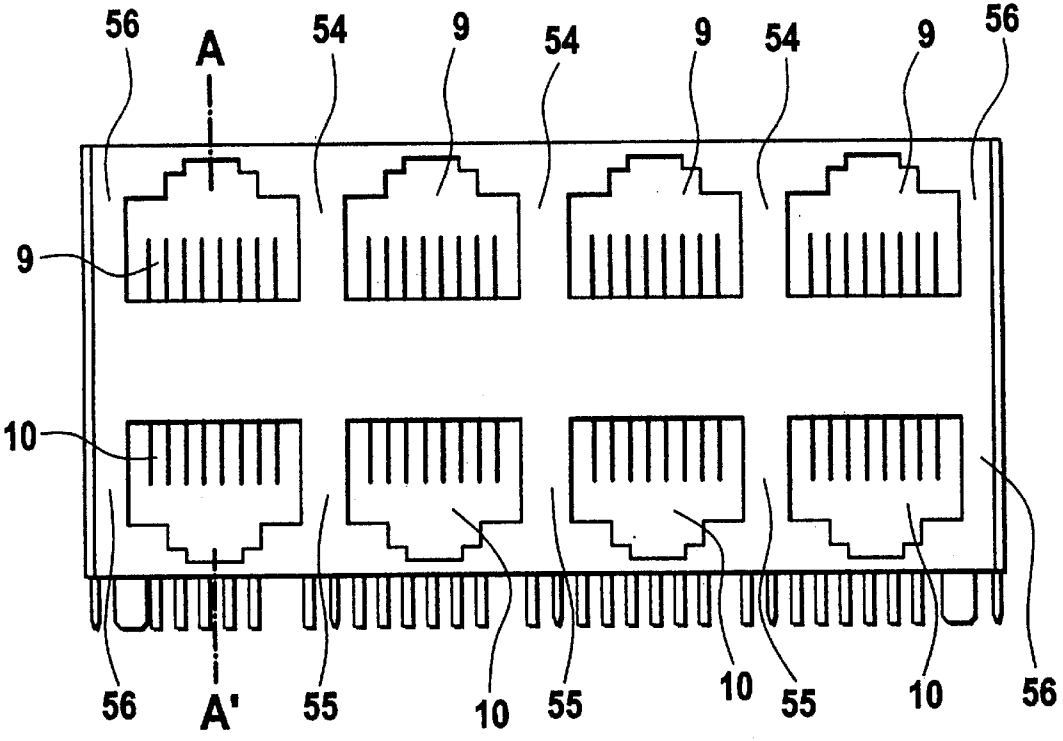
FIG. 8 shows a front view of an eightfold modular jack connector arrangement.

FIG. 8 may be referred to for a better understanding, by way of example, which figure shows a further embodiment of modular jack connector housing 11 with two rows of receptacles 9, 10 for respective associated RJ-45 mateable modular plug connectors. FIG. 8 shows the front view of a housing I I having eight receptacles 9, 10 and FIG. 9 shows a cross section through modular jack connector housing 11. The plane of the cross sectional view of FIG. 9 is plane A–A' shown in FIG. 8.

In this further embodiment, a particularly high packaging density is obtained due to the reduced thickness of partition walls 54 which are respectively arranged between receptacles 9, and the reduced thickness of partition walls 55 which are respectively arranged between receptacles 10. The thickness of partition walls 54 and 55 substantially corresponds to, or is even slightly smaller than, the thickness of outer walls 56. This multiple modular jack connector arrangement essentially can be used in all the embodiments according to the invention.

A further embodiment is described in detail in FIGS. 9 to 12.

The depth of the multiple modular jack connector arrangement shown in FIG. 9 is held very small due to the fact that elements 31 and 32 are arranged directly behind one another in the connector housing 11.

Contacts 1 to 8 and 1' to 8', as shown by way of example in FIG. 9 solely with respect to contacts 4 and 5', are connected to elements 31 and 32 by means of a foil conductor 57.

In an alternate embodiment, instead of foil conductors 57 terminal wires made of stamped and bent metal extend between elements 31 and 30 and to contacts 1 to 8 and 1' to 8'.

Figure 10:
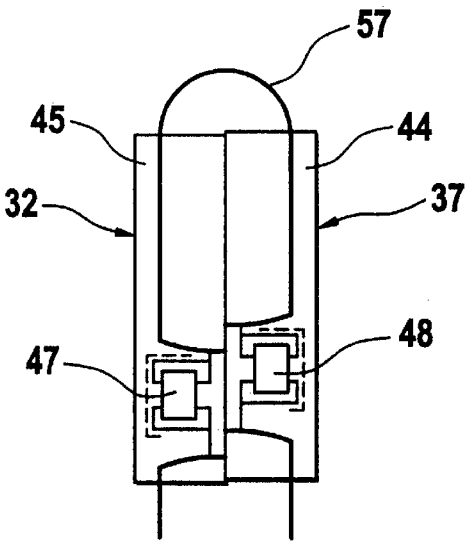
FIG. 10 shows an arrangement of two elements according to FIG. 9, insertable into the modular jack connector housing according to a further embodiment of the invention.

FIG. 10 shows the subassembly for dc separation and for filtering purposes having inductances 47, 48 in the insertable elements 31, 32 and also the connection to the foil conductor or to terminal wires 57 which at the respective end sections are embedded by injection molding within the dielectric housings 44 and 45.

Figure 11:
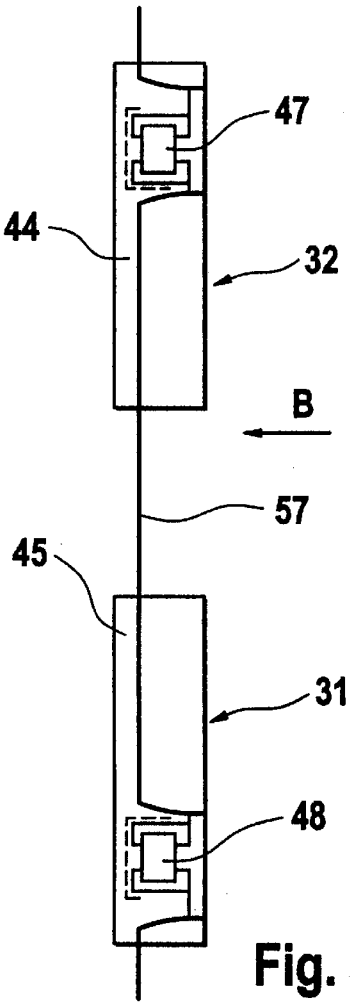
FIG. 11 is a view of the two insertable elements of FIG. 10, during an assembling step thereof.

FIG. 11 shows in a lateral cross section view, substantially corresponding to that of FIG. 10, the subassembly of elements 31, 32 during their assembly.

Figure 12:
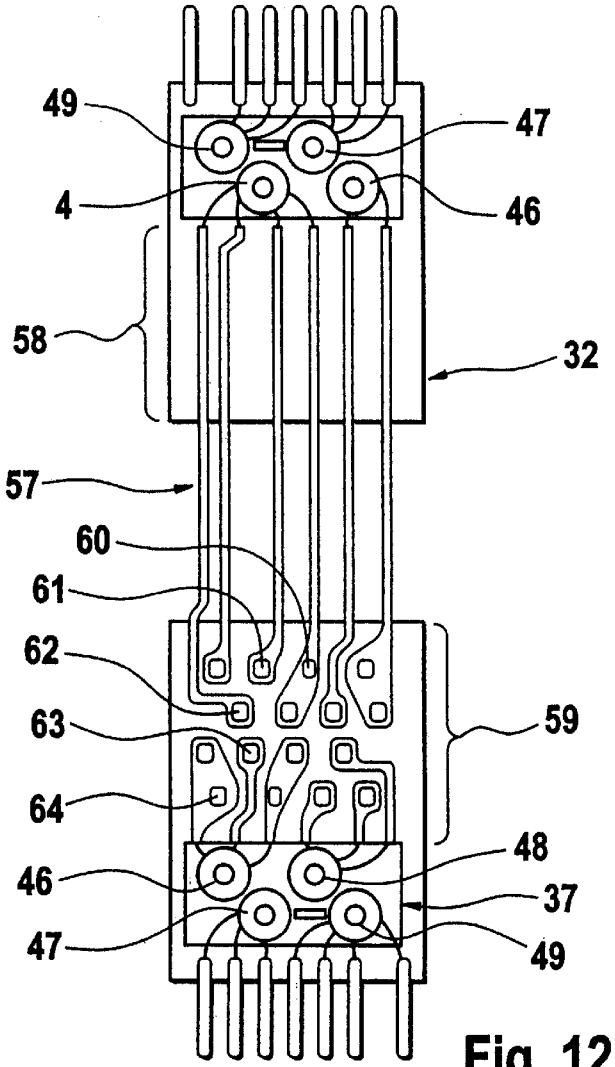
FIG. 12 is a view seen from the front of the insertable elements shown in FIG. 11.

FIG. 12 shows elements 30 and 31 as seen in the direction of arrow B of FIG. 11. Dielectric housings 44, 45 include holding sections 58 and 59 respectively, which are designed as thickened side walls of housing 44, 45.

The ends of the leads of the foil conductor or of terminal wires 57, which are arranged at holding section 59, have self-locking contacting openings for pin-shaped contacts, illustrated solely by way of example by means of reference numbers 60 to 64.

As shown in the cross sectional view of FIG. 9, contacts 4 and 5', i.e., also contacts 1 to 8 and 1' to 8' which are not shown in detail, are embedded by injection molding in dielectric modular jack connector housing 11, and their free ends 65 to 68 project laterally to the right of the housing.

When elements 31, 32 are introduced into insertion channel 23, contact connection surfaces 60 to 64 of the foil conductor or of contact wires 57, see FIGS. 11 and 12, first come into contact with free ends 65 to 68 which then extend through the connection surfaces and establish electrical contact.

Preferred electrical circuit arrangements are described below in more detail and with reference to FIGS. 13 to 17. The electrical circuitry includes inductances 46, 47, 48 and 49 located in elements 31 and 32, respectively.

In the description of the electrical circuit arrangement, it is furthermore presupposed that respective signals to be transmitted are applied to terminals a, b, c and e, f, g and are transferred to contact pair 1, 2 or 6, 8, and are further applied to an associated mateable modular plug connector. Signals to be received are transferred from the associated mateable modular plug to terminals a, b, c and/or e, f, g.

Consequently, in FIG. 3 external terminals a and c as well as e and g are, respectively shown connected to the primary side of the isolation transformers T1 and T2, which are formed by ferrite ring cores 46 and 48.

Figure 13:
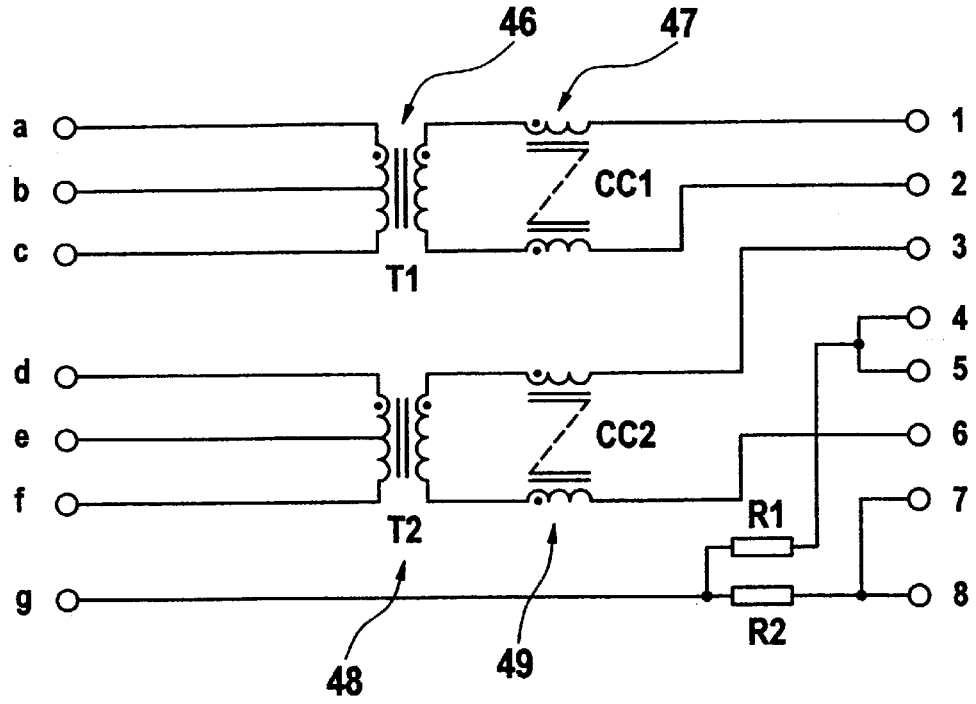
FIG. 13 is an electrical circuit diagram of the electrical elements of a modular jack connector.

Electrical transformers T1 and T2 define a subassembly for dc separation which separation is, in case of a complete galvanic decoupling as shown in FIGS. 13, a dc isolation.

Center taps b and f establish respective midpoint reference potentials, so that the primary sides of isolation transformers T1 and T2 may be respectively driven with symmetrical input signals, which type of signal also is known as "dual rail signal".

A respective common mode choke coil 47 or 49 is connected to the secondary side (or primary side) of isolation transformers T1 and T2. Thus, common mode choke coil 47 suppresses in-phase or common mode signal portions at contacts 1 and 2, and common mode choke coil 49 suppresses corresponding signal potions at contact pair 3, 6. Thus, common mode choke coils 47 and 49 define a filtering device apt to suppress respective undesired signal portions.

The contacts 4 and 5, which are connected together and which preferably contact an unused conductor pair are connected to resistor R1; and contacts 7 and 8, which are connected together, are connected to resistor R2. The second sides of resistors R1 and R2 are connected to the external connection i. Hereby the unused conductor pair may be grounded by application of a ground potential or suitably chosen direct current reference potential to external connection i. Thus any interference signals produced on these lines may be connected to ground there.

Figure 14:
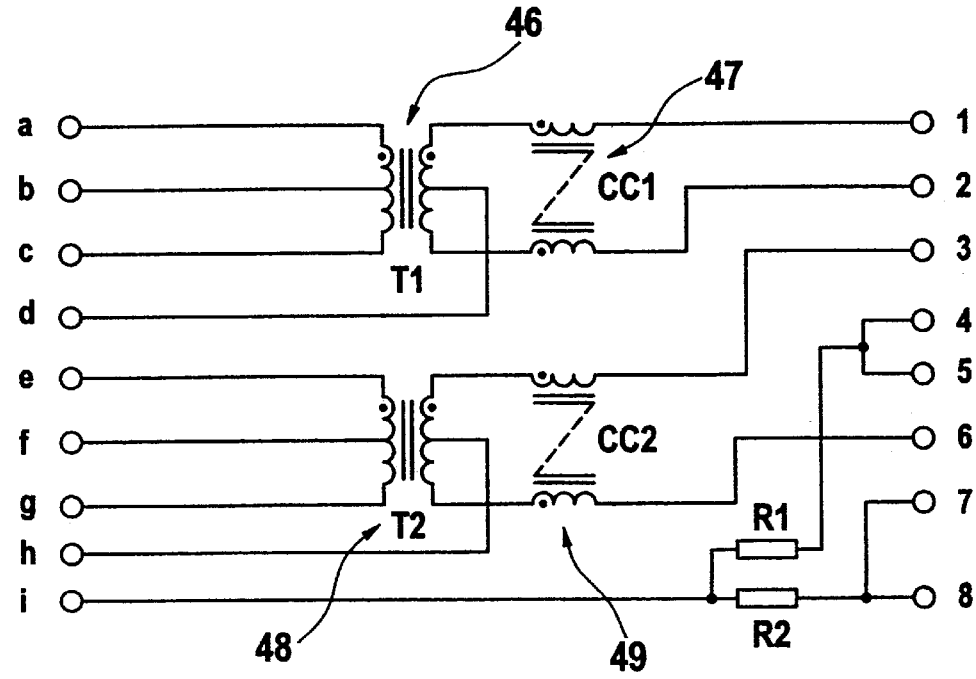
FIG. 14 shows a further embodiment of the circuit arrangement shown in FIG. 13.

Reference is made to FIG. 14 now, which corresponds to FIG. 13 except for external connections d and h. External connections d and h are connected to the secondary side of isolation transformer T1 or T2, in order to provide a predetermined reference potential at the secondary side of isolation transformers T1 and T2. Common mode choke coil 47 becomes fully effective only by means of this potential, which is preferably placed at the shielding potential. The same holds true for external terminal h ad common mode choke coil 49.

Figure 15:
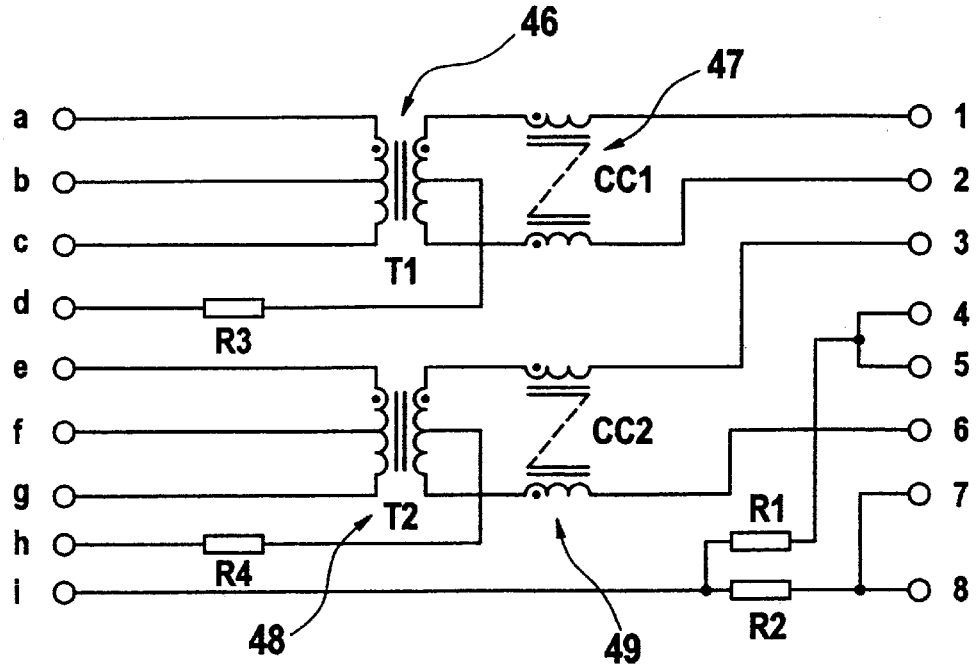
FIG. 15 shows an alternative embodiment of the electrical circuit arrangement shown in FIG. 14.

A further alternate embodiment of the electrical circuit arrangement shown in FIG. 14 is shown in FIG. 15. It further includes resistors R3 and R4 in the secondary side connection lead to the respective center taps of isolation transformers T1 or T2, by which means the center taps of isolation transformers T1 or T2 are grounded. A suitable impedance for transmission may be provided at contact pair 1, 2 or 3, 6 by means of the respective resistors R3 and R4.

Figure 16:
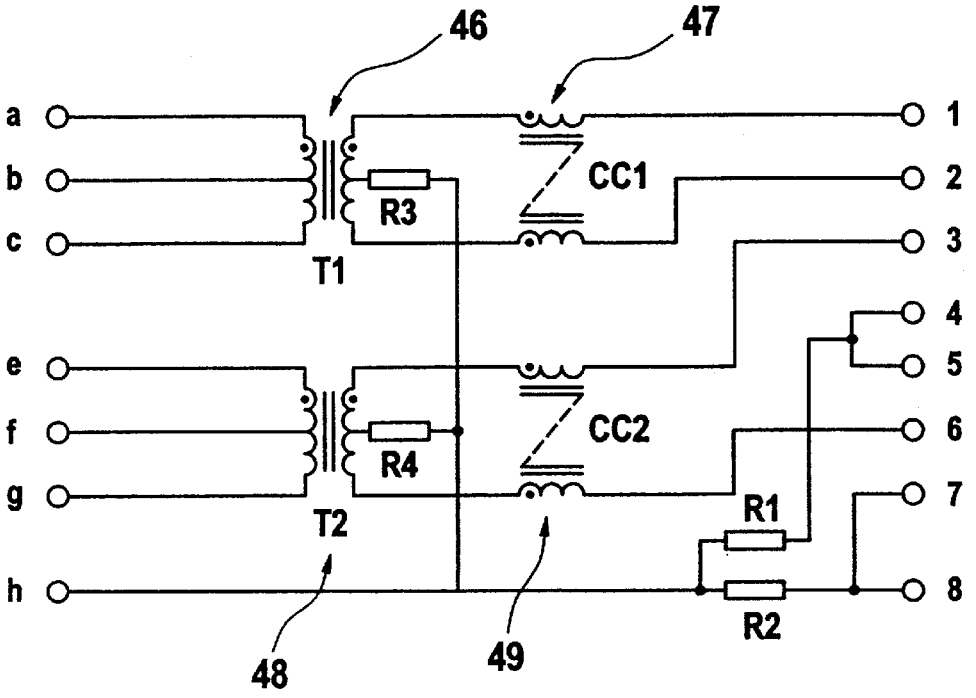
FIG. 16 shows an embodiment alternative to the embodiment of the electrical circuit arrangement shown in FIG. 15.

When external connections d and h, shown in FIG. 15, are connected within the plug connector to external connection i, then the electrical circuit arrangement which is shown in FIG. 16 is obtained. This circuit arrangement has the same reference potential which is applied to external terminal h, both at the unused conductor paid and also with reference to the midpoint potential of a signal at contact pairs 1, 2 or 3, 6.

Figure 17:
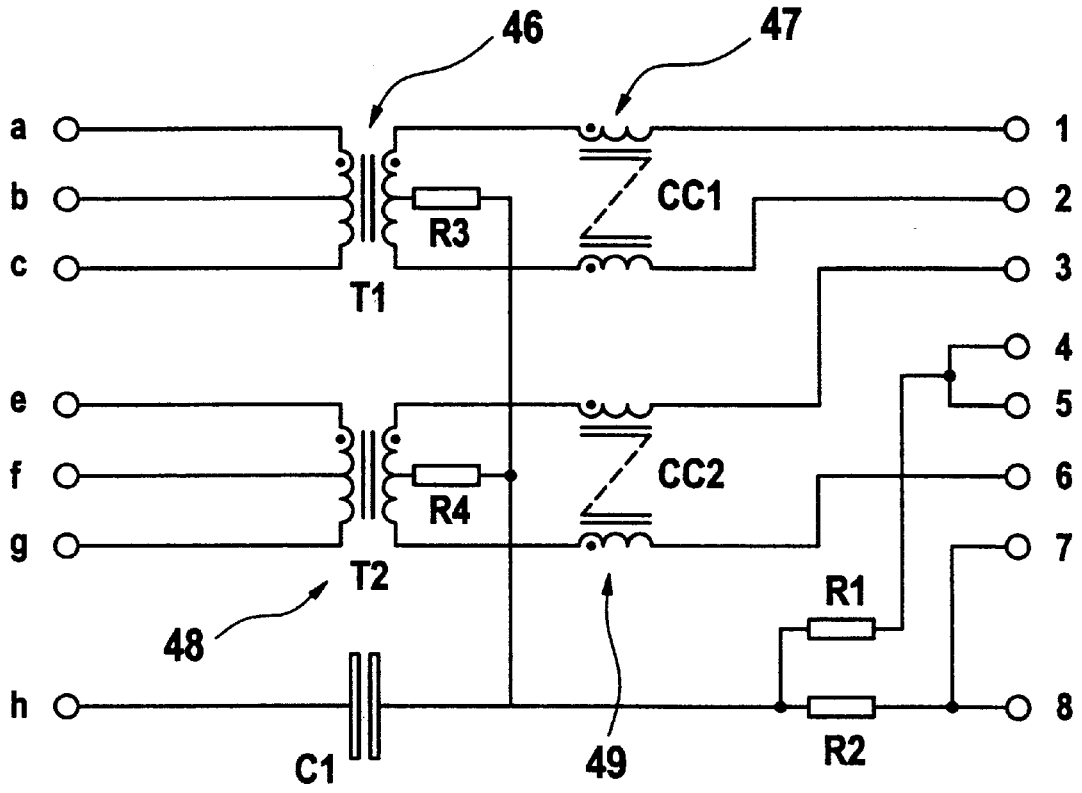
FIG. 17 shows a further alternative design of the electrical circuit arrangement shown in FIG. 16.

A further alternate embodiment of the circuit arrangement shown in FIG. 16 will become apparent from FIG. 17.

By insertion of a capacitor C1 in the lead to external terminal h, a direct current (dc) decoupled and potential-free connection arrangement is provided with respect to contacts 1 to 8; however, for higher frequencies, a common reference potential may be provided hereby for the unused conductor pair 4, 5 and a midpoint potential of the signals may be established at contact pairs 1,2 and 3,6.

Although the invention has been described with reference to specific embodiments, it is not limited to these embodiments. For example, it is within the scope of the invention to apply a conductive metallization layer for shielding purposes on the exterior of the dielectric plug connector housing 11, or to use instead of the metallization layer a metallic shield to surround the plug connector housing.

What is claimed is:

1. A modular jack connector comprising a dielectric connector housing, a plurality of contacts mounted in said connector housing for engaging contacts of a mateable connector when said mateable connector is inserted into a receptacle defined by said connector housing, a plurality of external terminals for establishing an external electrical connection to said modular jack type connector, a subassembly for a dc current isolation of the engaging contacts from said external terminals, and a filtering device, wherein the improvement comprises an element which is substantially completely insertable into said connector housing, which insertable element holds both, said engaging contacts and said external terminals, which insertable element accommodates said subassembly for a dc current isolation and said filtering device;

said subassembly for a dc current isolation and the filtering device comprises inductances having coils with ferrite ring cores, the longitudinal axes of which are aligned in parallel and are laterally offset from each other; and said inductances accommodated within the dielectric housing of said insertable elements are each connected to a section of the external terminals which sections project into said dielectric housing, and to a section of said engaging contacts which sections project said dielectric housing.

2. A modular jack connector according to claim 1, wherein said insertable element comprises a substantially square shaped dielectric housing having side walls through which sections of the engaging contacts and sections of the external terminals extend, and wherein the dielectric housing of said insertable element holds the respective engaging contact sections and said external terminal sections in the irrespective assembled positions.

3. A modular jack connector according to claim 1, wherein said ferrite ring cores are arranged within the dielectric housing of the insertable element in one plane and adjacent to each other.

4. A modular jack connector according to claim 1, wherein the components of said subassembly for dc current separation and filtering device are embedded in a permanently elastic dielectric material contained within the dielectric housing of said insertable element.

5. A modular jack connector according to claim 1, wherein said engaging contacts are arranged mutually adjacent and form laterally outward extending arches which extend mutually parallel, and which project in the assembled position of said insertable element into the interior of said receptacle.

6. A modular jack connector according to claim 5, wherein said engaging contacts comprise, in addition to said laterally outwardly extending arches, a further curved region which curved region increases the effective resilient length of said respective contacts.

7. A modular jack connector according to claim 1, wherein said dielectric connector housing comprises a plurality of receptacles for receiving respective mateable connectors, and wherein an insertable element is associated with each receptacle.

8. A modular jack connector according to claim 2, wherein said dielectric connector housing comprises two rows of receptacles for receiving mateable connectors, and wherein in each receptacle the contacts are mounted in two rows and in mirror image of each other.

9. A modular jack connector comprising a dielectric connector housing, a plurality of contacts mounted in said connector housing for engaging contacts of a mateable connector when said mateable connector is inserted into a receptacle defined by said connector housing, a plurality of external terminals for establishing an external electrical connection to said modular jack type connector, a subassembly for a dc current isolation of the engaging contacts from said external terminals, and a filtering device, wherein the improvement comprises an element which is substantially completely insertable into said connector housing, which insertable element holds both, said engaging contacts and said external terminals, which insertable element accommodates said subassembly for a dc current isolation and said filtering device;

said subassembly for a dc current isolation and the filtering device comprises inductances having coils with ferrite ring cores, the longitudinal axes of which are aligned in parallel and are laterally offset from each other; and said electrical leads defining predetermined electric circuits are connected between said inductances within the dielectric housing of said insertable element.

* * * * *